US005415086A

United States Patent [19]

Robbins

[11] Patent Number: 5,415,086

[45] Date of Patent: May 16, 1995

[54] APPARATUS FOR STORING AND COMPACTING RECYCLABLE AND NONRECYCLABLE WASTE MATERIALS IN SEPARATE STORAGE COMPARTMENTS, THE CAPACITY OF WHICH CAN BE READILY VARIED

[75] Inventor: James K. Robbins, Fayette, Ala.

[73] Assignee: Marathon Equipment Company, Vernon, Ala.

[21] Appl. No.: 676,106

[22] Filed: Mar. 27, 1991

[51] Int. Cl.[6] ..... B30B 7/00; B65F 3/20

[52] U.S. Cl. ..... 100/99; 100/185; 100/193; 100/208; 100/225; 100/229 A; 100/242; 100/245; 100/255; 220/909

[58] Field of Search ..... 100/185, 193, 208, 221, 100/225, 229 A, 237, 240, 242, 245, 246, 252, 255, 215, 99; 220/529-531, 909; 414/512, 517, 525.6

[56] References Cited

U.S. PATENT DOCUMENTS

| | | | |
|---|---|---|---|
| 45,550 | 12/1864 | Fellows . | |
| 49,047 | 7/1865 | Webster | 100/208 |
| 60,376 | 12/1866 | Howe . | |
| 210,542 | 12/1878 | Kulp | 100/225 X |
| 215,502 | 5/1879 | Bikle . | |
| 240,068 | 4/1881 | Wright | 100/208 |
| 297,915 | 4/1884 | Burgess | 100/225 X |
| 382,822 | 5/1888 | McKinney | 100/208 X |
| 404,655 | 6/1889 | Preston | 100/225 |
| 457,631 | 8/1891 | Dederick | 100/225 |
| 662,028 | 11/1900 | Ross | 100/225 |
| 936,149 | 10/1909 | Sacker . | |
| 992,006 | 5/1911 | Kubersky et al. | 220/531 |
| 2,381,272 | 8/1945 | Fischer | 100/237 X |
| 3,507,410 | 4/1970 | Liberman et al. | 100/240 |
| 3,695,175 | 10/1972 | Bausenbach et al. | 100/229 A X |
| 3,787,830 | 1/1974 | Cato et al. | 100/229 A X |
| 3,808,967 | 5/1974 | Fair et al. | 100/221 |
| 3,863,779 | 2/1975 | Stockman | 100/99 X |
| 3,878,774 | 4/1975 | Frossard | 100/229 A X |
| 4,045,152 | 8/1977 | Peterson et al. | 100/193 X |
| 4,070,962 | 1/1978 | Peterson | 100/245 X |
| 4,096,956 | 6/1978 | Gaskin | 100/215 X |
| 4,113,125 | 9/1978 | Schiller | 100/242 |
| 4,114,776 | 9/1978 | Pluss | 220/531 |
| 4,372,726 | 2/1983 | Lutz | 100/193 X |
| 4,424,740 | 1/1984 | Gwathney et al. | 100/99 X |
| 4,557,658 | 12/1985 | Lutz | 100/193 X |
| 4,741,455 | 5/1988 | Robbins . | |
| 4,775,283 | 10/1988 | Krapp et al. . | |
| 5,001,978 | 3/1991 | Discepolo | 100/225 X |
| 5,035,563 | 7/1991 | Mezey | 414/512 X |

FOREIGN PATENT DOCUMENTS

| | | | |
|---|---|---|---|
| 0365514 | 4/1990 | European Pat. Off. . | |
| 3510700 | 9/1986 | Germany | 100/221 |
| 8706418 U | 8/1987 | Germany | 100/193 |
| 9011335 U | 11/1990 | Germany . | |

*Primary Examiner*—Stephen F. Gerrity
*Attorney, Agent, or Firm*—Shlesinger Arkwright & Garvey

[57] ABSTRACT

A preferred embodiment includes first and second waste storage compartments for storing separately nonrecyclable and recyclable waste products. A compression member is operably associated with the first and second waste storage compartments for compressing waste material therein. The compression member includes a ram operably connected to a piston and cylinder assembly. The ram is displaced along a single directional path to compress waste material in both the first and second waste storage compartments. An adjustable member is operably associated with the first and second waste storage compartments for varying the storage capacity thereof. The adjustment member includes a baffle extending substantially the length of the first and second waste storage compartments. The baffle is hingedly connected to a support member. Upper and lower doors are associated with each of the first and second storage compartments. A latch mechanism is secured to the baffle and operates to prevent the opening of the upper doors of the first and second storage compartments depending upon the position of the baffle.

9 Claims, 5 Drawing Sheets

APPARATUS FOR STORING AND COMPACTING RECYCLABLE AND NONRECYCLABLE WASTE MATERIALS IN SEPARATE STORAGE COMPARTMENTS, THE CAPACITY OF WHICH CAN BE READILY VARIED

FIELD OF THE INVENTION

The present invention is directed to devices for storing and compacting waste materials. More specifically, a preferred embodiment of the present invention is directed to a compacting and storage unit designed to store recyclable and nonrecyclable waste in separate storage compartments, the storage capacity of which can be readily varied.

BACKGROUND OF THE INVENTION

It is well known to use trash compacting and storage units at commercial and residential locations to compact and temporarily store waste materials therein. The environmental and economic advantages of disposing of waste in this manner are well known.

A number of previously known trash compacting and storage units contain only a single waste storage compartment for storing waste material therein. The waste storage compartment is of a fixed size. Compacting and storage units of this type can not separately store recyclable and nonrecyclable waste products therein. Accordingly, these compacting storage units hamper the extremely important efforts to improve the environment by recycling waste materials. Moreover, the capacity of the storage compartment of the above type of compactors cannot be readily varied to accommodate differing needs of individuals and business proprietors.

It has previously been proposed to provide a transportable waste storage container with two side-by-side storage compartments. Recyclable waste is stored in one of these storage compartments and a different class of waste is stored in the other storage compartment. Each of these waste storage compartments includes a single opening for receiving and dispensing waste materials. These openings remain exposed. The waste storage containers detachably connect to a transfer unit having two rams, each communicating with only one of the waste storage compartments. The transfer unit includes two charging boxes, each operably associated with a storage compartment and a corresponding ram. Waste is deposited in the appropriate charging box and directed into the associated waste storage compartment by the corresponding ram. The container is transported by a truck having a specially designed chassis. The aforementioned waste storage container has numerous disadvantages associated therewith. Specifically, the container requires the use of two rams for compacting waste materials stored in the separate compartments. This significantly increases the cost as well as the overall size of the waste compacting and storage unit. Further, a piston and cylinder assembly is associated with each ram. The use of two piston and cylinders assemblies further increases the size and the cost of the compacting unit. Finally, the size of the each of the two side-by-side storage compartments is fixed.

The fixed size or storage capacity of the side-by-side storage compartments is undesirable for a number of reasons. One such is that the size of the storage compartments cannot be adjusted to accommodate the needs of an individual or commercial establishment. More specifically, one business proprietor's needs may require a greater storage capacity for nonrecyclable waste materials than recyclable waste materials. Accordingly, this business proprietor will prefer to have a larger nonrecyclable waste storage compartment than recyclable waste storage compartment. Previously known compacting units could not be adapted to accommodate this proprietor's need. Rather, the nonrecyclable waste storage compartment would readily fill up while the recyclable waste compartment remains only partially filled. The compacting unit at this point must be transferred to a waste station to dispose of the waste material stored therein, even though the recyclable waste storage compartment is only partially filled. Of course, the same holds true for a business proprietor whose needs are such that a greater size recyclable waste storage compartment is desirable.

OBJECTS AND SUMMARY OF THE INVENTION

An object of the present invention is to overcome one or more of the disadvantages associated with previously known waste compacting and storage units.

Another object of the present invention is to provide an apparatus for compacting waste materials which includes at least a first waste storage compartment means for storing waste materials therein. Compression means is operably associated with the first waste storage compartment means for compacting waste materials stored therein. Adjustment means is operably associated with the first waste storage compartment means for adjusting the capacity of the first waste storage compartment means. An apparatus formed in this manner is desirable, for among other reasons, because the size of the waste storage compartment means can be readily varied to accommodate the specific needs of a particular individual or business proprietor.

A further object of the present invention is to provide an apparatus for compacting waste materials which includes first and second waste storage compartment means for storing waste materials therein. Compression means is operably associated with the first and second waste storage compartment means for compressing waste materials stored therein. Adjustment means is operably associated with the first and second waste storage compartment means for adjusting the storage capacity thereof. The above apparatus is a significant improvement over previously known devices. The first and second waste storage compartments permit the storage of recyclable waste materials separate from nonrecyclable waste materials. Further, by providing adjustment means operably associated with the first and second waste storage compartment means, the above apparatus can be readily adapted to accommodate the differing waste storage needs of individuals.

Still a further object of the present invention is to provide an apparatus for compressing waste materials which includes first and second waste storage compartment means for storing waste materials therein. Compression means is operably associated with the first and second waste storage compartment means for compressing waste materials stored therein. The compression means includes a ram and displacement means for displacing the ram along a single path for compressing waste materials stored in both the first and second waste storage compartment means. The above novel and unobvious invention has a number of advantages inherent thereto. Specifically, a single ram can compress waste materials in both the first and second waste storage compartment means. Further, the ram travels along the same path for compressing the waste materials in both the first and second waste storage compartment means. This arrangement significantly reduces the complexity as well as the overall cost of the compacting unit.

Yet another object of the present invention is to provide an apparatus for compressing waste materials which includes first and second waste storage compartment means for storing waste materials therein. Compression means is operably associated with the first and second waste storage compartment means for compressing waste materials stored therein. The compression means includes a ram and displacement means for displacing the ram between a storage position and an operating position for compressing waste materials stored in both the first and second waste storage compartment means. The ram is disposed in at least a portion of both of the first and second waste storage compartment means when in the operating position. The first and second waste storage compartments of the apparatus recited above facilitates the environmentally important process of recycling by providing separate storage compartments for nonrecyclable and recyclable waste products. Also, the provision of a single ram which can compress waste materials in both the first and second waste storage compartment means reduces the size and cost of the compacting unit.

Still yet another object of the present invention is to provide a method for compressing waste material which includes the steps of: a) providing first waste storage compartment means for storing waste materials therein; b) providing second waste storage compartment means for storing waste materials therein; c) providing compression means operably associated with the first and second waste storage compartment means for compressing waste materials stored therein, the compression means including a ram and displacement means for displacing the ram; and, d) displacing the ram along a single path to compress waste materials stored in the first and second waste storage compartment means. The above method of compressing waste materials has a number of desirable attributes not found in previously known methods for doing the same. By providing first and second waste storage compartment means, it is readily possible to store separately nonrecyclable and recyclable waste materials. Further, displacing a ram along a single path to compress waste materials stored in the first and second waste storage compartment means obviates the need for dual rams or for a single ram which must be moved from a first position to compress waste material in the first storage compartment and a second position to compress waste material in the second storage compartment.

Yet still another object of the present invention is to provide a method for compressing waste material which includes the steps of: a) providing a first waste storage compartment means for storing waste materials therein; b) providing a second waste storage compartment means for storing waste materials therein; c) providing compression means operably associated with the first and second waste storage compartment means for compressing waste materials stored therein; and, d) providing adjustment means operably associated with the first and second waste storage compartment means for adjusting the storage capacity of the first and second waste storage compartment means. The method recited above for compressing waste materials is a significant improvement over previously known methods for doing the same. Specifically, the above method permits recyclable and nonrecyclable waste materials to be stored separately. Furthermore, the size of the first and second waste storage compartment means can be readily adjusted to accommodate the particular waste storage needs of an individual or proprietor.

In summary, a preferred embodiment includes first and second waste storage compartments for storing separately nonrecyclable and recyclable waste products. A compression member is operably associated with the first and second waste storage compartments for compressing waste material therein. The compression member includes a ram operably connected to a piston and cylinder assembly. The ram is displaced along a single path to compress waste material in both the first and second waste storage compartments. An adjustable member is operably associated with the first and second waste storage compartments for varying the storage capacity thereof. The adjustment member includes a baffle extending substantially the length of the first and second waste storage compartments. The baffle is hingedly connected to a support member. Upper and lower doors are associated with each of the first and second storage compartments. A latch mechanism is secured to the baffle and operates to prevent the opening of the upper doors of the first and second storage compartments depending upon the position of the baffle.

DETAILED DESCRIPTION OF THE DRAWINGS

DETAILED DESCRIPTION OF THE INVENTION

The preferred embodiment of the present invention will be described hereinafter with reference made to FIGS. 1 through 7.

Figure 1:
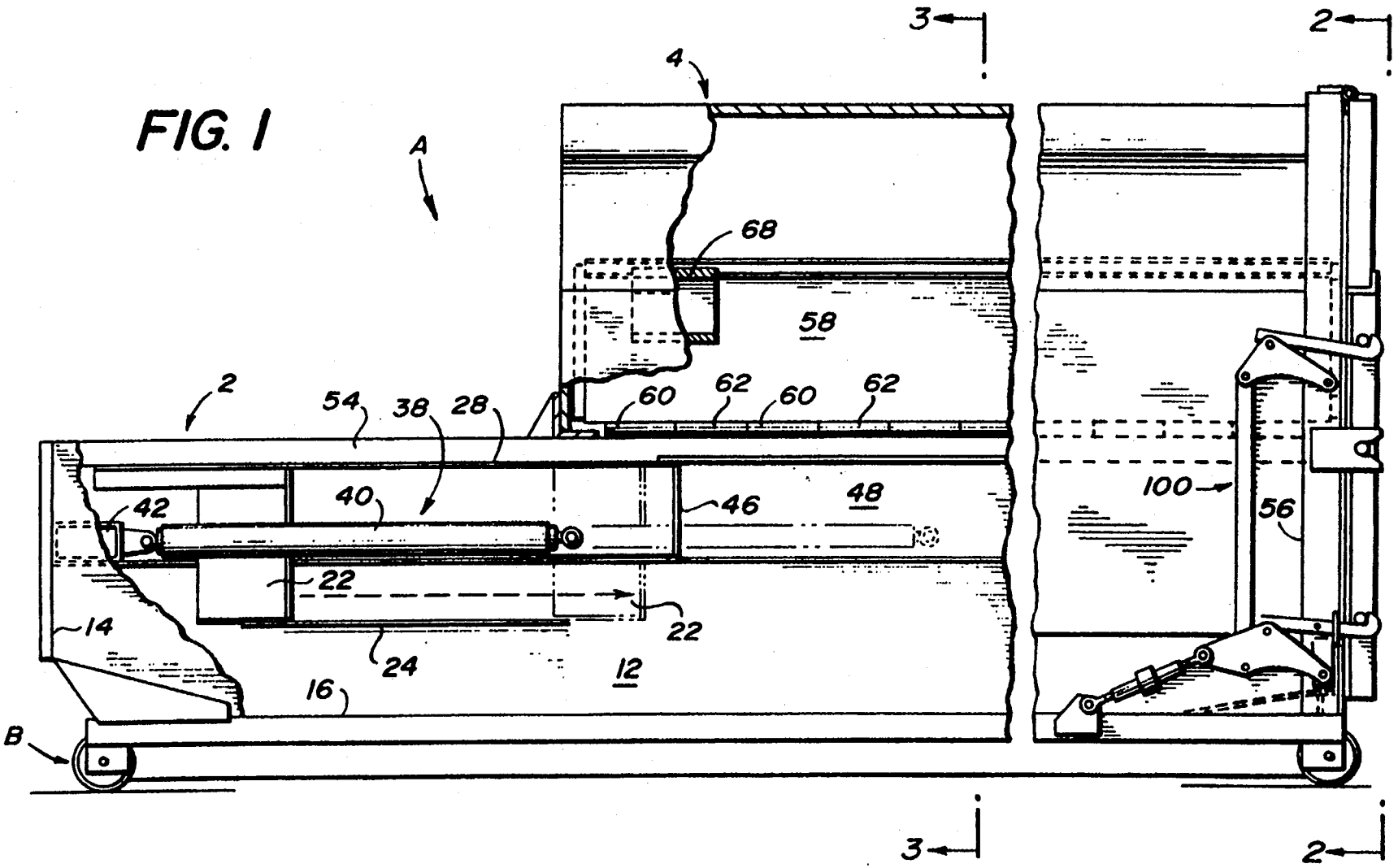
FIG. 1 is a fragmentary side elevational view of a preferred embodiment of the present invention with portions thereof broken away.

Referring to FIG. 1, a compacting and storage unit A is mounted on a roll-on/roll-off skid B. The compacting and storage unit A includes a compactor 2 and a waste storage container 4 permanently fixed thereto. However, it will be readily appreciated that the compactor 2 may be detachably secured to the storage container 4.

Figure 6:
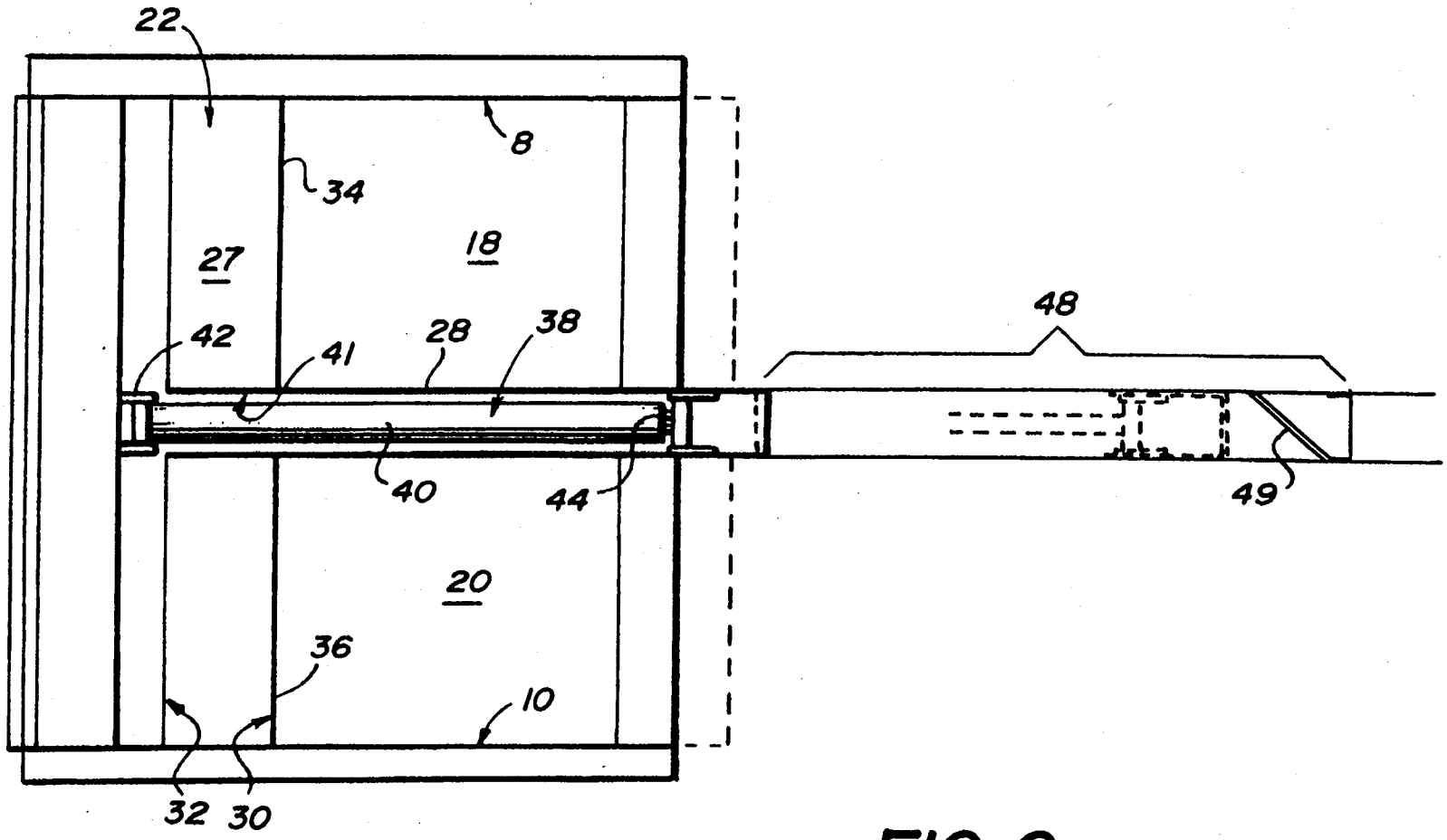
FIG. 6 is a fragmentary cross-sectional view taken along lines 6—6 in FIG. 3.
Figure 7:
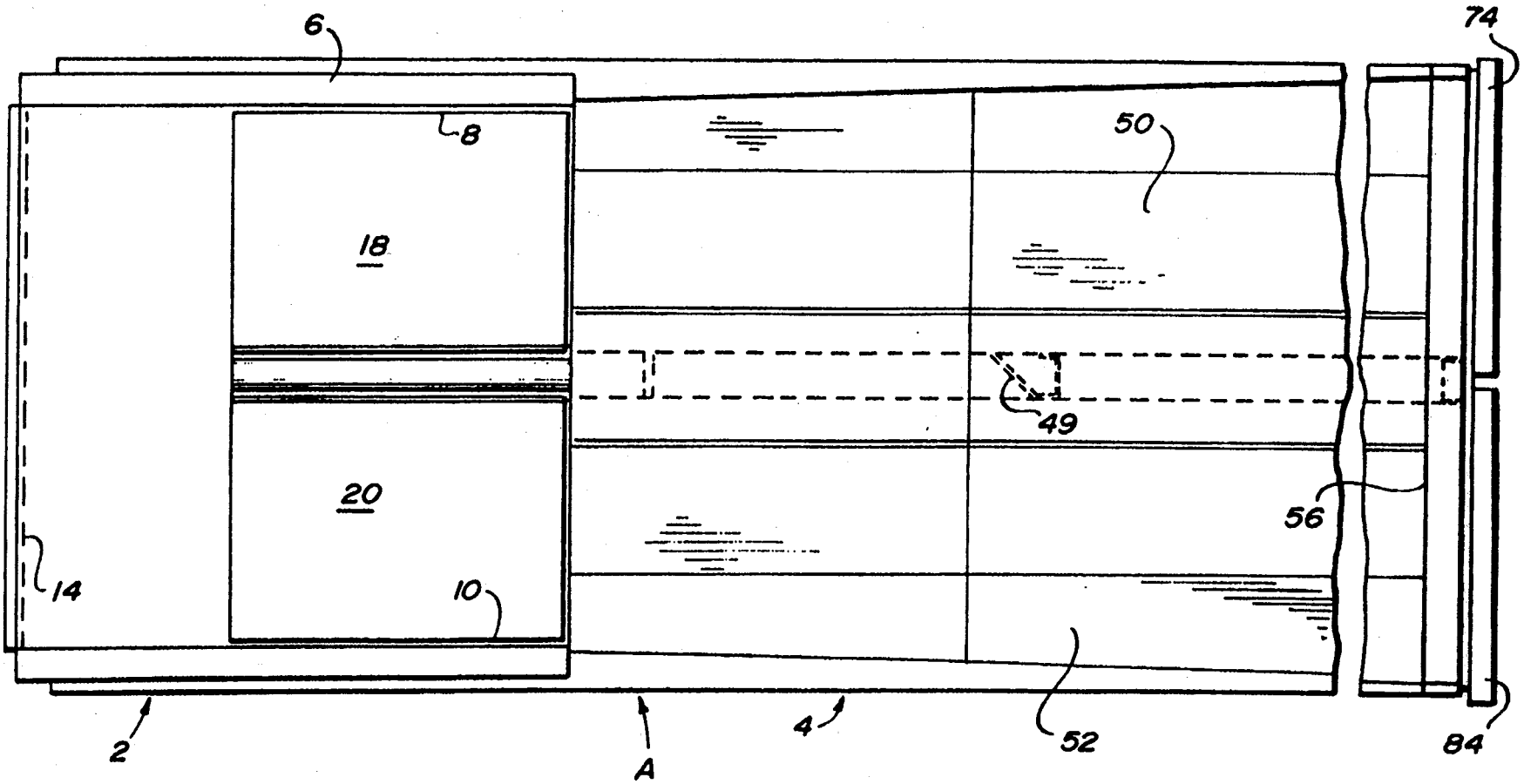
FIG. 7 is a plan view of the embodiment illustrated in FIG. 1.

Referring to FIG. 7, the upper surface 6 of compactor 2 has a pair of substantially rectangularly shaped openings 8 and 10 through which waste materials may be deposited. The compactor 2 further includes a substantially L-shaped divider 12 extending forwardly from the left end 14 and upwardly from floor 16 of compactor 2, as best seen in FIG. 1. The divider 12 partitions the compactor 2 into a first charging chamber 18 and a second charging chamber 20, best shown in FIGS. 6 and 7.

Figure 3:
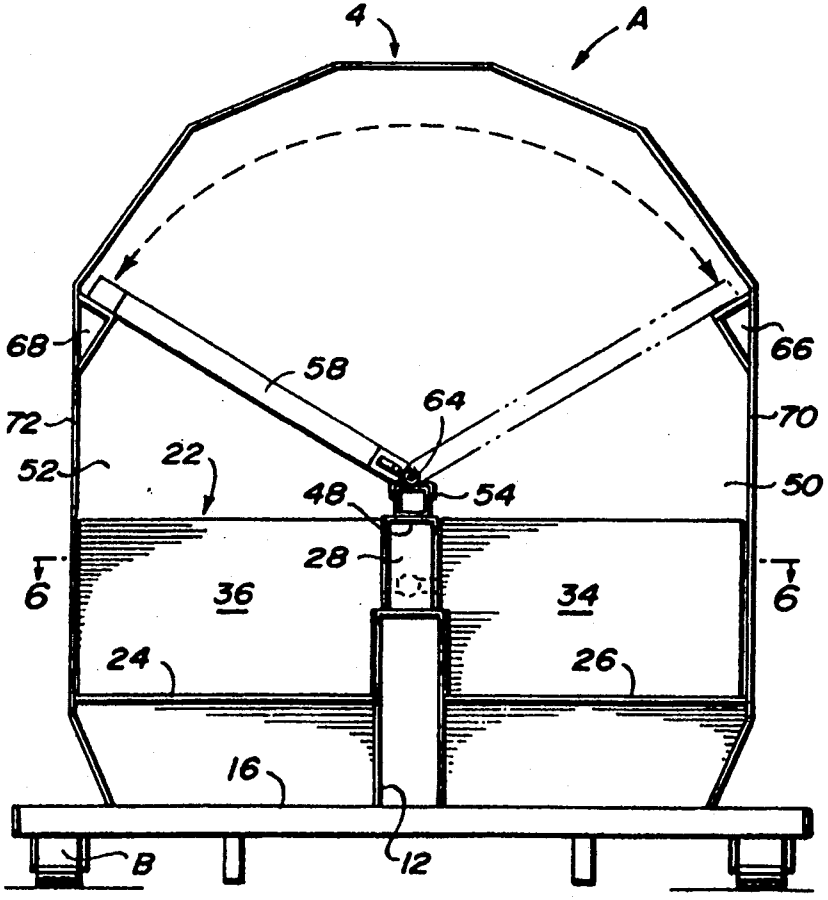
FIG. 3 is a cross-sectional view taken along lines 3—3 in FIG. 1.

The compactor 2 further includes a ram 22 slideably mounted on the divider 12 and horizontally extending support plates 24 and 26, as best shown in FIGS. 1 and 3. Referring to FIG. 6, the ram 22 includes a body 27 and an elongated guide snout 28. The body 26 has a substantially C-shaped channel extending from the front face 30 to the rear face 32. The width of the substantially C-shaped channel is slightly greater than the width of the divider 12 thereby permitting the divider 12 to slideably support the ram 22. The guide snout 28 is positioned directly above the substantially C-shaped channel and extends forwardly from the front surface 30. The guide snout 28 divides the ram 22 into a first operating face 34 and a second operating face 36, as best shown in FIG. 3.

A single piston and cylinder assembly 38 is operably connected to the ram 22. The piston and cylinder assembly 38 includes a cylinder 40 secured to the left end 14, as viewed in FIG. 1, of the compactor 2 by a supporting member 42. The cylinder 40 extends forwardly from left end 14 through opening 41 in body 27 and into snout 28, as best shown in FIG. 6. A piston 44 is slideably disposed within the cylinder 40 and is secured at its exposed end to the interior of the guide snout 28, as best seen in FIG. 6. A control system (not shown) is operably connected to the piston and cylinder assembly 38 to extend and retract the piston 44 in cylinder 40. The control system may be of the hydraulic or pneumatic type. As seen in FIG. 1, the forwardmost end 46 of guide snout 28 is positioned in the front end of substantially rectangularly shaped guide channel 48 when piston 44 is in the retracted position.

Referring to FIG. 6, the guide channel 48 includes an angled plate 49 positioned in the forwardmost end thereof. An opening (not shown) is formed in the right side wall of guide channel 48 opposite angle plate 49. The opening in the snout 48 permits an operator to remove any debris which may have accumulated therein. The guide channel 48 provides additional support for the ram 22 and prevents misalignment thereof.

As is readily apparent from FIG. 1, when piston 44 is extended to the operating position, shown in dotted lines, all waste materials deposited in either the first or second charging chambers 18 and 20, respectively, is directed into the storage container 4 by ram 22.

The substantially L-shaped divider 12 extends along substantially the entire length of the storage container 4 thereby partitioning the same into first and second storage compartments 50 and 52, respectively. The substantially L-shaped divider 12 includes a lower section forming the stem thereof and a raised section forming the base thereof. The raised section extends from the left end (as viewed in FIG. 1) of guide channel 48 to right end 56 of storage container 4. The lower section of divider 12 extends from left end 14 to the right end of guide channel 48. A support channel 54 is disposed above channel 48 and extends from the left end 14 of compactor 2 to the right end 56 of the storage container 4, as viewed in FIG. 1.

A floating baffle 58 is pivotally connected to the support channel 54. Specifically, a plurality of hollow collars 60 and 62 are mounted on a longitudinally extending rod 64. As best seen in FIGS. 1 and 3, the collars 60 and 62 are intermittently positioned along the rod 64. The collars 60 are fixed to the support channel 54 and movable relative to the baffle 58. The collars 62 are permanently fixed to the baffle 58 and movable relative to the support channel 54. Thus, the collars 60 and 62 and rod 64 act similar to a door or piano hinge to permit rotation of the floating baffle 58. Stops 66 and 68 are formed on opposing side walls 70 and 72, respectively, of storage container 4 to limit movement of baffle 58. A flexible sealing member may be provided along the top, left, and right sides of floating baffle 58 to provide a liquid tight seal between the first storage compartment 50 and the second storage compartment 52. The divider 12 provides a fluid-tight seal between the lower portion of waste storage compartment 50 and the lower portion of waste storage compartment 52.- In a number of instances the fluid- tight seal need only be maintained for the height of divider plate 12. Therefore, the flexible sealing member extending along the floating baffle 58 may be omitted.

Figure 2:
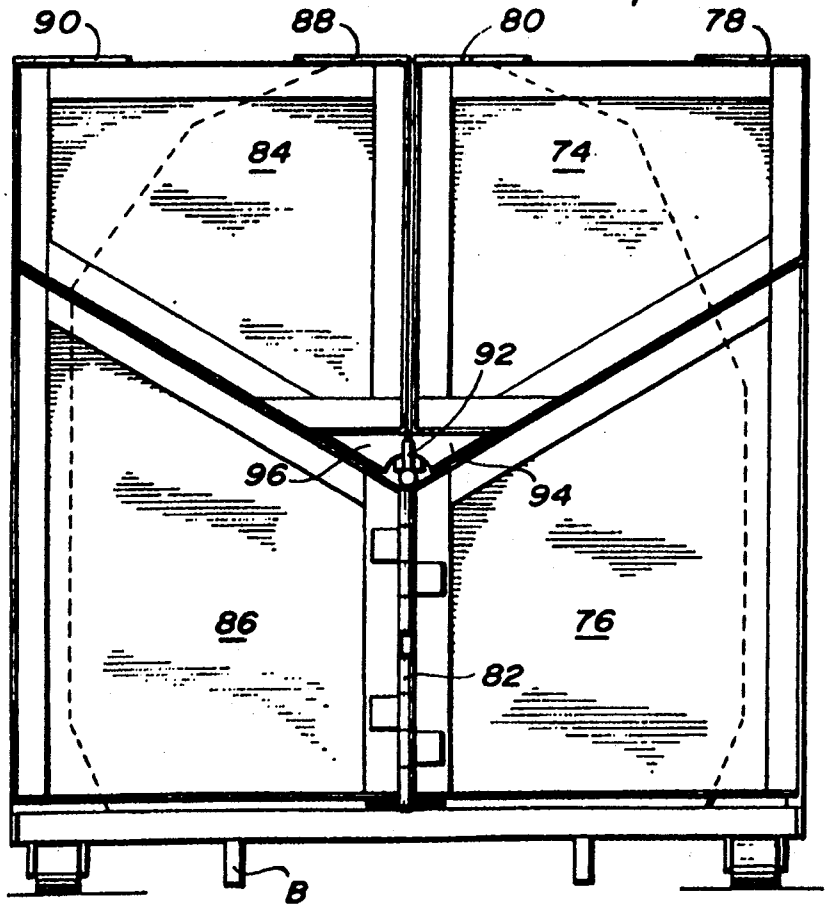
FIG. 2 is an elevational view depicting the front end of the embodiment illustrated in FIG. 1.

Referring to FIGS. 1 and 2, upper and lower doors 74 and 76, respectively, are hingedly connected to the right end 56 of the storage container 4 adjacent the first storage compartment 50. Specifically, upper door 74 is pivotally connected, via hinges 78 and 80, to the top of storage container 4. The upper door 74 is pivoted about hinges 78 and 80 to open and close the same. Lower door 76 is pivotally connected to a center portion of storage container 4 via hinge 82. The door 76 is rotated to the left and right about the hinge 82 to open and close the same.

Upper and lower doors 84 and 86, respectively, are pivotally connected to the storage container 4 adjacent the second storage compartment 52. The upper door 84 is hingedly connected to the top of the storage container 4 via hinges 88 and 90. The upper door 84 is opened and closed in a similar manner as door 74. Lower door 86 is pivotally connected to the center portion of storage container 4 via hinge 82. Lower door 86 is opened and closed in a similar manner as door 76.

Figure 4:
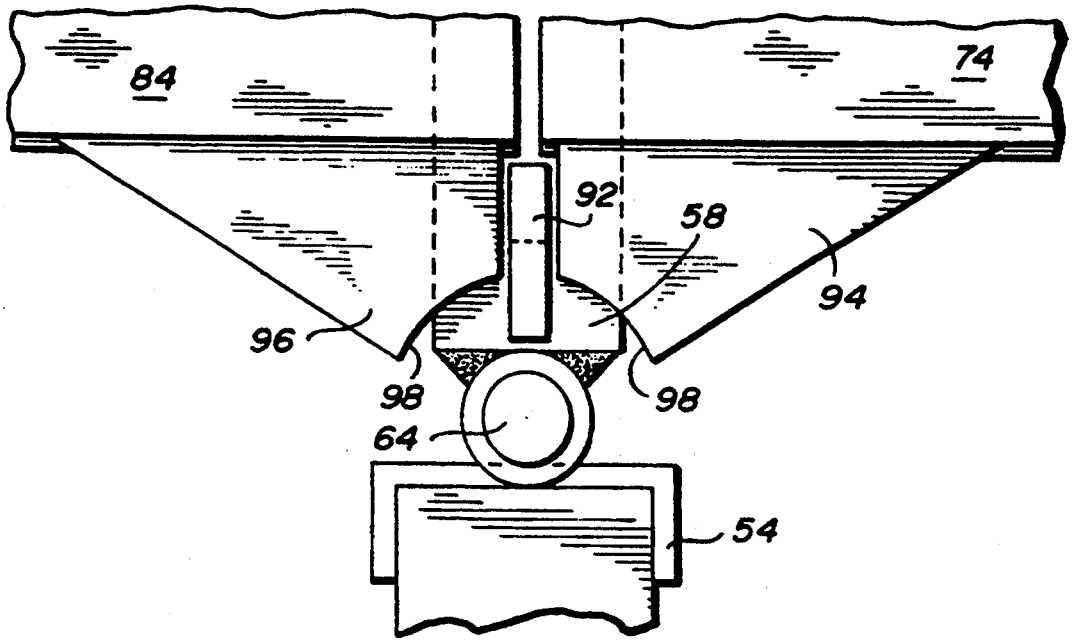
FIG. 4 is a fragmentary and enlarged front elevational view of the latch mechanism formed in accordance with the preferred embodiment of the present invention.
Figure 5:
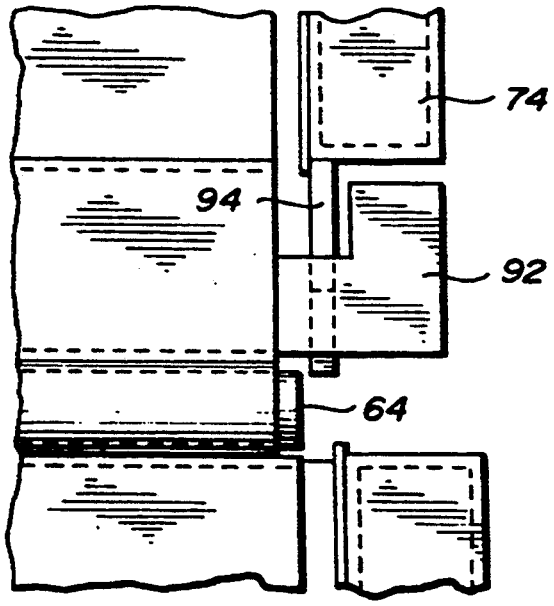
FIG. 5 is a fragmentary side elevational view of the latch mechanism illustrated in FIG. 4.

Referring to FIGS. 4 and 5, an L-shaped latch 92 is fixedly secured to floating baffle 58. Thus, the L-shaped latch 92 rotates with the floating baffle 58. As seen in FIG. 4, the upper doors 74 and 84 include substantially triangularly-shaped lips 94 and 96, respectively. The lips 94 and 96 each include an arcuate inner portion 98 which cooperates with the L-shaped latch 92. If the floating baffle is positioned anywhere from a position slightly left of the vertical position shown in FIG. 4 to a position abutting the stop 68, latch 92 will prevent the opening of door 84. Similarly, if the baffle 58 is at any position from that just slightly right of the vertical position shown in FIG. 4 to stop 66 the latch 92 will prevent opening of door 74. This feature prevents intermixing of the waste materials stored in the first and second storage compartments 50 and 52, respectively, when emptying the compacting and storage unit A. If the baffle 58 is in the position shown in FIG. 4, i.e. the vertical position, doors 74 and 84 may both be opened and closed. Further, since latch 92 is secured to and moves with floating baffle 58 and is disposed on the exterior of the storage unit A, it indicates the position of the floating baffle 58 to an operator prior to opening of the upper and lower doors.

Referring to FIG. 1, a ratchet latch mechanism 100 latches the left side of lower door 86 to the left side of storage container 4, as viewed in FIG. 2. The ratchet latch mechanism 100 is of the type disclosed in U.S. Pat. No. 4,741,455 and U.S. patent application Ser. No. 658,960 (now abandoned) which are incorporated herein by reference and thus will not be described in detail hereinafter. Although not shown, a similar ratchet latch mechanism secures the right side of lower door 76 to the right side of storage container 4.

METHOD OF OPERATION

The preferred method of operating the compactor and storage unit A will be described hereinafter.

First a determination must be made whether to use storage compartment 50 or 52 for the storage of recyclable waste materials. Either storage compartment 50 or 52 could be used for this purpose. Of course, once one of the storage compartments is designated for recyclable waste materials the other will be used for nonrecyclable waste materials. The following description will be based on the assumption that the first waste storage compartment 50 is to be used to store recyclable waste materials therein.

If the ram 22 is in the operating position, i.e. the dotted line position shown in FIG. 1, the control system (not shown) is activated to retract the piston 44 into cylinder 40 thereby returning the ram 22 to the storage position shown in full lines in FIG. 1. If it is desired to deposit recyclable waste materials into the compacting and storage unit A, an individual deposits the recyclable waste materials into the first charging chamber 18 through opening 8. The control system is again activated to cause the piston 44 to extend which in turn directs the guide snout 28 through guide channel 48 and the operating face 34 forward to assist the recyclable waste material into the first waste storage compartment 50.

On the other hand, if nonrecyclable waste material is to be deposited into the compacting and storage unit A, the waste material is deposited into the second charging chamber 20 through opening 10 when the ram is in the storage position. Subsequently, the control system is activated to extend the piston 44 which in turn directs snout 28 through guide channel 48 and second operating face 36 forward to assist the waste material into the second waste storage compartment 52.

It will be readily appreciated that recyclable and nonrecyclable waste may be inserted into their respective openings 8 and 10 simultaneously. This procedure is desirable because recyclable and nonrecyclable waste may be compacted in waste storage compartments 50 and 52, respectively, with a single operating stroke of ram 22. Since ram 22 has two operating faces 34 and 36 aligned with storage compartments 50 and 52, respectively, the ram 22 need not be displaced along a path transverse to the operating stroke to align the ram with the appropriate storage compartment prior to the compacting step. Moreover, this arrangement obviates the need for multiple rams and multiple piston and cylinder assemblies. Therefore, this feature significantly reduces the complexity and expense of the compacting and storage unit A.

Assuming that the individual's recyclable waste storage needs are greater than his nonrecyclable waste storage needs, the first waste storage compartment 50 will fill up much faster than the second waste storage compartment 52. This will cause the floating baffle 58 to rotate to the left, as seen in FIG. 3, until it meets stop 68. Once the floating baffle 58 abuts stop 68, as best shown in FIG. 3, the capacity of the first storage compartment 50 is at a maximum. It will be readily appreciated that the floating baffle 58 may be positioned anywhere between stops 66 and 68 depending upon the relative amounts of recyclable and nonrecyclable waste material stored therein.

Once the compacting and storage unit A is filled to capacity, it is transported by a conventional tractor trailer to a waste disposal site. It may be desirable to initially unload the first waste storage compartment 50, since it has the greater amount of waste material therein. However, it will be readily appreciated that the second waste storage compartment 52 could be emptied first. To empty waste storage compartment 50, the lower door 76 is pivoted 180° about hinge 82. Subsequently, upper door 74 is pivoted 270° about hinges 78 and 80 to lie on the top of waste storage container 4. It will be readily appreciated that conventional fasteners may be provided to secure the doors 74 and 76 in their respective open positions. Door 76 must be opened first because a lip is provided on door 74 (not shown) which underlies door 76 in the closed positioned. The L-shaped latch 92 prevents the upper door 84 from being open, since the baffle is in abutting engagement with the stop 68. The recyclable waste materials are then emptied from the first storage compartment 50 through doors 74 and 76. To empty the second waste storage compartment 52, the operator merely opens lower door 86 after first closing lower door 76 and dispenses the waste material stored therein. Of course, depending upon the position of floating baffle 58 it may also be necessary to open upper door 84 to empty second waste storage compartment 52.

It will be readily appreciated from the above that floating baffle 58 automatically accommodates the individual's waste storage needs. More specifically, an individual need not preset the desired final position of floating baffle 58. Rather, the final position of floating baffle 58 will be automatically determined by the relative amounts of recyclable and nonrecyclable waste materials.

While this invention has been described as having a preferred design, it is understood that it is capable of further modifications, uses and/or adaptions of the invention following in general the principle of the invention including such departures from the present disclosure as come within the known or customary practice in the art to which the invention pertains, and as may be applied to the central features set forth and fall within the scope of the invention and the limits of the appended claims.

I claim:

1. An apparatus for compressing waste materials, comprising:

a) a first waste storage compartment means for storing waste materials therein;

b) compression means operably associated with said first waste storage compartment means for compressing waste materials stored therein;

c) adjustment means operably associated with said first waste storage compartment means for adjusting the storage capacity of said first waste storage compartment means, said adjustment means includes a support member and a plate pivotally connected to said support member;

d) second waste storage compartment means for storing waste materials therein;

e) said adjustment means includes first and second stops operably associated with said plate for limiting movement thereof;

f) said first waste storage compartment means has a capacity less than said second waste storage compartment means when said plate is in abutting engagement with said first stop means;

g) said first waste storage compartment means has a capacity greater than said second waste storage compartment means when said plate is in abutting engagement with said second stop means;

h) at least one door operably associated with said first waste storage compartment means;

i) at least one door operably associated with said second waste storage compartment means; and, j) latch means fixedly secured to said plate to prevent said door of said first waste storage compartment means from opening when said plate is in abutting engagement with said first stop and to prevent said door of said second waste storage compartment means from opening when said plate is in abutting engagement with said second stop.

2. An apparatus as in claim 1, wherein:

a) said latch means permits said doors of said first and second waste storage compartment means to be opened simultaneously when said plate extends substantially parallel to a vertical axis.

3. An apparatus as in claim 1, wherein:

a) upper and lower doors are operably associated with each of said first and second waste storage compartment means; and, b) said latch means is operably associated with only said upper doors of said first and second waste storage compartment means.

4. An apparatus for compressing waste materials, comprising:

a) at least a first waste storage compartment having an interior and an exterior;

b) at least a first ram disposed adjacent to and operably associated with said first waste storage compartment for compressing materials disposed in said interior thereof;

c) an adjustment member operably associated with said first waste storage compartment, said adjustment member being movable by the waste material stored in said first waste storage compartment and thereby automatically adjusting the storage capacity of said first waste storage compartment based on the amount of waste material stored therein; and, d) an adjustment member position indicator for indicating a position of said adjustment member from the exterior of said first waste storage compartment.

5. An apparatus for compressing waste materials, comprising:

a) first waste storage compartment means for storing waste materials therein;

b) second waste storage compartment means for storing waste materials therein;

c) compression means operably associated with said first and second waste storage compartment means for compressing waste materials stored therein;

d) said compression means including a ram and displacement means for displacing said ram along a single path for compressing waste materials stored in both said first and second waste storage compartment means;

e) said ram having at least one operating face and a guide member extending forwardly of said at least one operating face in the direction of said first and second waste storage compartment means;

f) adjustment means operably associated with said first and second waste storage compartment means for automatically adjusting the storage capacity of said first and second waste storage compartment means;

g) said adjustment means including first and second support members, said second member being adjustably secured to said first member; and, h) said first members having an opening for receiving said guide member of said ram.

6. An apparatus as in claim 5, wherein:

a) said displacement means includes a piston and cylinder assembly.

7. An apparatus as in claim 6, wherein:

a) said piston and cylinder assembly is disposed adjacent to said first and second operating faces.

8. An apparatus for compressing waste materials, comprising:

a) first waste storage compartment means for storing waste materials therein;

b) second waste storage compartment means for storing waste materials therein;

c) compression means operably associated with said first and second waste storage compartment means for compressing waste materials stored therein;

d) said compression means including a ram and displacement means for displacing said ram along a single path for compressing waste materials stored in both said first and second waste storage compartment means;

e) said ram having at least one operating face and a guide member extending forwardly of said at least one operating face in the direction of said first and second waste storage compartment means;

f) adjustment means operably associated with said first and second waste storage compartment means for automatically adjusting the storage capacity of said first and second waste storage compartment means;

g) said ram includes first and second operating faces for compressing waste materials in said first and second waste storage compartments, respectively;

h) said first operating face is removed from and extends substantially parallel to said second operating face; and, i) said guide member is positioned intermediate said first and second operating faces.

9. An apparatus as in claim 8, wherein:

a) said displacement means includes a piston and cylinder assembly;

b) at least a portion of said piston and cylinder assembly extends beyond said first and second operating faces in the direction of said first and second waste storage compartment means.

* * * * *